US007202446B2

(12) United States Patent
Shalev et al.

(10) Patent No.: US 7,202,446 B2
(45) Date of Patent: Apr. 10, 2007

(54) ELECTRIC SHAVER WITH VIBRATING HEAD

(75) Inventors: Pinchas Shalev, Kfar-Saba (IL); Zion Azar, Shoham (IL)

(73) Assignee: Radiancy Inc., Orangeburg, NY (US)

( * ) Notice: Subject to any disclaimer, the term of this patent is extended or adjusted under 35 U.S.C. 154(b) by 0 days.

(21) Appl. No.: 10/530,501

(22) PCT Filed: Mar. 13, 2003

(86) PCT No.: PCT/IL03/00219

§ 371 (c)(1),
(2), (4) Date: Apr. 6, 2005

(87) PCT Pub. No.: WO2004/080232

PCT Pub. Date: Sep. 23, 2004

(65) Prior Publication Data

US 2006/0070988 A1 Apr. 6, 2006

(51) Int. Cl.
*A45D 1/04* (2006.01)

(52) U.S. Cl. ..... 219/222; 219/223; 30/140

(58) Field of Classification Search ..... 219/222–223, 219/225, 227–231, 240–241; 30/140, 34.05; 132/224–225, 269
See application file for complete search history.

(56) References Cited

U.S. PATENT DOCUMENTS

| | | | | |
|---|---|---|---|---|
| 558,465 | A | 4/1896 | Bell | |
| 589,445 | A | 9/1897 | Seide | |
| 1,054,520 | A | 2/1913 | Eldridge | |
| 1,744,525 | A * | 1/1930 | Chase | 132/118 |
| 1,926,520 | A | 9/1933 | Fox | |
| 2,134,960 | A | 11/1938 | Testi | |
| 2,324,148 | A | 7/1943 | Gravin | |
| 2,727,132 | A | 12/1955 | Hills | |
| 3,093,724 | A | 6/1963 | Johnson | |
| 3,176,114 | A | 3/1965 | Kneisley | |
| 3,197,612 | A | 7/1965 | Reich | |
| 3,365,797 | A | 1/1968 | Cook | |
| 3,421,216 | A | 1/1969 | Anna | |
| 3,474,224 | A | 10/1969 | Carter | |
| 3,521,529 | A | 7/1970 | Strand | |
| 3,524,045 | A | 8/1970 | Siegel | |
| 3,526,750 | A | 9/1970 | Siegel | |
| 3,614,381 | A | 10/1971 | Politzer | |
| 3,902,042 | A | 8/1975 | Goldfarb et al. | |
| 3,925,889 | A * | 12/1975 | Albert | 30/43.8 |

(Continued)

FOREIGN PATENT DOCUMENTS

BE 748225 8/1970

(Continued)

OTHER PUBLICATIONS

Rusting, R.L.; "Hair—Why it Grows, Why it Stops"; Jun. 2001; Scientific American; vol. 48; No. 6; pp. 56-63.

(Continued)

*Primary Examiner*—Robin Evans
*Assistant Examiner*—Vinod Patel

(57) ABSTRACT

A hair cutting apparatus comprising: an elongate element (260) heated to a temperature capable of cutting hair; a vibrating structure (200), on which said elongate element (260) is mounted; and a housing (106) in which the vibrating structure (200) is mounted.

31 Claims, 4 Drawing Sheets

U.S. PATENT DOCUMENTS

| | | | | |
|---|---|---|---|---|
| 3,934,115 | A | 1/1976 | Peterson | |
| 3,935,974 | A | 2/1976 | Weyn | |
| 4,051,760 | A | 10/1977 | Glennan | |
| 4,130,955 | A | 12/1978 | Baumgartner et al. | |
| 4,155,164 | A | 5/1979 | White | |
| 4,206,555 | A | 6/1980 | Musto | |
| 4,254,324 | A | 3/1981 | Vratric | |
| 4,539,467 | A | 9/1985 | Wenger | |
| 4,608,978 | A | 9/1986 | Rohr | |
| 4,617,926 | A | 10/1986 | Sutton | |
| 4,745,260 | A | 5/1988 | Albinger, Jr. et al. | |
| 4,819,669 | A | 4/1989 | Politzer | |
| 4,940,466 | A | 7/1990 | Paduano et al. | |
| 5,021,634 | A | 6/1991 | Santoro | |
| 5,064,993 | A | 11/1991 | Hashimoto | |
| 5,065,515 | A | 11/1991 | Iderosa | |
| 5,270,520 | A | 12/1993 | Barzilai et al. | |
| 5,317,385 | A | 5/1994 | Silva et al. | |
| 5,554,838 | A | 9/1996 | Berdich | |
| 5,595,568 | A | 1/1997 | Anderson et al. | |
| 5,606,798 | A * | 3/1997 | Kelman | 30/41.5 |
| 5,633,003 | A | 5/1997 | Cantor | |
| 5,683,380 | A | 11/1997 | Eckhouse et al. | |
| 5,885,273 | A | 3/1999 | Eckhouse et al. | |
| 5,968,034 | A | 10/1999 | Fullmer et al. | |
| 5,993,440 | A | 11/1999 | Ghassemi | |
| 6,032,365 | A * | 3/2000 | Hodges | 30/43.6 |
| 6,080,146 | A | 6/2000 | Altshuler et al. | |
| 6,111,222 | A * | 8/2000 | Hattori | 219/240 |
| 6,187,001 | B1 | 2/2001 | Azar et al. | |
| 6,228,074 | B1 | 5/2001 | Almeida | |
| 6,235,015 | B1 | 5/2001 | Mead, III et al. | |
| 6,246,027 | B1 | 6/2001 | Griffiths | |
| 6,307,181 | B1 | 10/2001 | Hashimoto | |
| 6,383,176 | B1 | 5/2002 | Connors et al. | |
| 6,481,104 | B1 * | 11/2002 | Parker et al. | 30/45 |
| 6,514,243 | B1 | 2/2003 | Eckhouse et al. | |
| 6,595,985 | B1 | 7/2003 | Tobinick | |
| 6,824,542 | B2 | 11/2004 | Jay | |
| 6,825,445 | B2 | 11/2004 | Shalev | |
| 6,836,966 | B2 | 1/2005 | Patrick | |
| 2002/0004986 | A1 | 1/2002 | Werner et al. | |
| 2003/0037793 | A1 * | 2/2003 | Hwang | 132/118 |
| 2004/0098863 | A1 | 5/2004 | Shalev et al. | |

FOREIGN PATENT DOCUMENTS

| | | | |
|---|---|---|---|
| DE | 846 150 | | 8/1952 |
| DE | 23 43 493 | | 3/1975 |
| DE | 34 06 966 | | 8/1985 |
| EP | 0 102 289 | | 3/1984 |
| EP | 0 201189 | | 11/1986 |
| EP | 0 736 308 | | 10/1996 |
| EP | 0 788 814 | | 6/1997 |
| EP | 0 888 733 | | 1/1999 |
| EP | 1 269 881 | | 1/2003 |
| FR | 2 531 655 | | 2/1984 |
| FR | 2 612 381 | | 9/1988 |
| FR | 2716402 | A1 * | 8/1995 |
| GB | 658068 | | 10/1951 |
| IT | 1 201 364 | | 1/1989 |
| JP | 1 288291 | | 11/1989 |
| JP | 01288291 | A * | 11/1989 |
| JP | 5 228016 | | 9/1993 |
| JP | 8 223783 | | 8/1996 |
| WO | WO 82/03520 | | 10/1982 |
| WO | WO 99/19123 | | 4/1999 |
| WO | WO 03/009976 | | 2/2003 |
| WO | WO 03/009977 | | 6/2003 |
| WO | WO 04/080232 | | 9/2004 |

OTHER PUBLICATIONS

Bello Y.M. et al.: "Infection and Wound Healing"; WOUNDS: A Compendium of Clinical Research and Practice; 2001, vol. 13, No. 4, pp. 127-131.

* cited by examiner

ELECTRIC SHAVER WITH VIBRATING HEAD

RELATED APPLICATIONS

The present application is a US National Phase of PCT Application No. PCT/IL2003/000219, filed on Mar. 13, 2003.

FIELD OF THE INVENTION

The present invention relates to removing hair with a heat element.

BACKGROUND OF THE INVENTION

The removal of unwanted hair from the body can be accomplished with mechanized means, for example razors, tweezers or wax, all of which are uncomfortable to use, irritate the skin and/or cause damage to the skin.

The use of heated wires or other structures to cut hair from a skin surface has been proposed. However, a heat generator that generates heat of a sufficient magnitude to cut hair and is offset from the skin to prevent skin damage, often leaves behind unwanted stubble.

In Peterson, U.S. Pat. No. 3,934,115, parallel metal strips on the upper side of ceramic facing that contacts the skin, are used to cut hair. Hills, in U.S. Pat. No. 2,727,132 and P. Massimo in IT 1201364, use a continuously heated element to burn hair. P. M. Bell in U.S. Pat. No. 558,465, D. Seide in U.S. Pat. No. 0,589,445, G. S. Hills in U.S. Pat. No. 2,727,132, G. L. Johnson in U.S. Pat. No. 3,093,724, Hashimoto in U.S. Pat. No. 5,064,993 and U.S. Pat. No. 6,307,181 B1, F. Solvinto in FR 2531655 and EP 0201189, and E. Michit in 2612381, use a continuously heated wire to burn hair. J. F. Carter in U.S. Pat. No. 3,474,224, provides a circular comb device for burning nose hairs. These references do not appear to provide a means of reducing the hairs to the level of the skin.

Vrtaric, in U.S. Pat. No. 4,254,324, provides a heat hair cutting system that is applied only to the tips of the hair to remove the split ends.

The present applicants have disclosed a heat-generating system for cutting hair in PCT publications WO 03/009977 and WO 03/009976. The disclosures of these applications are incorporated herein in their entirety by reference. These applications describe methods and devices in which a wire providing pulsed or non-pulsed heat is used to cut hair. As used herein, a heat-generating wire refers to one or more of: metal wires, ribbons or any other type of heat-generating elements capable of generating heat of sufficient magnitude and/or duration to cut hair from an area of skin. In general, all of the configurations of wires, etc. disclosed in either of the above referenced applications. In addition, the structures and methods described herein are usable in or in conjunction with the structures disclosed therein.

In the above referenced PCT applications, the hair is severed close to the skin by heating the hair. This severing of the hair may also destroy at least a portion of the hair below the skin. As used herein the term "cut" is used to describe this type of severing or shaving of the hair.

SUMMARY OF THE INVENTION

According to an aspect of some embodiments of the present invention, a wire generating heat sufficient to cut hair, is mounted on a structure adapted for cutting hair and vibrated in relation to hair on an area of skin, thereby making multiple passes relative to the hair.

In an exemplary embodiment, the heat-generating wire is vibrated in relation to the structure by a vibrating mechanism. The preferred direction of vibration is generally parallel to the skin of the user and generally perpendicular to the ling dimension of the wires. The mechanism, for example, may comprise a motor having an asymmetrically weighted rotatable component. Other known methods and/or apparatus for causing vibration can also be used.

Optionally, the structure comprises a motion detector that turns the vibrating mechanism on or off in response to motion of the structure (i.e., the frame) along the skin. Alternatively or additionally, the motion detector switches the vibrator on or off when the structure moves above or below a minimum speed in relation to the area. Optionally, the motion detector, in addition to controlling vibrations, controls the duration of the heat period provided by the heat-generating wire. Optionally, the motion detector comprises a mechanical detector or an optical detector. Alternatively, the motion detector may, at least near the threshold modify the temperature or vibrations rather than turn them on or off at the threshold. As used herein the terms "turn-on" or "turn-off" include such more limited modifications.

According to an aspect of some embodiments of the present invention, a structure adapted for cutting hair from an area of skin comprises an opening having a heat-generating wire mounted on a frame therein and two or more elongate skin depressing elements have their long dimension directed toward the opening and the wire. Optionally, the elongate elements are planar with the skin or form an acute angle of less than 15 degrees, optionally less than 5 degrees with the skin (i.e., the plane of the opening). Optionally, the two or more skin depressing elements comprise two or more rows of skin depressing elements, separated by and directed toward a gap in which the wire is located.

Optionally, the wire is mounted on two of more posts in the opening and the opening comprises two or more post protectors positioned to prevent the posts from contacting the skin, for example by having one or more of the skin depressing elements project further from the device than the other elements or by the posts being covered by a solid element.

According to an aspect of some embodiments of the present invention, a structure adapted for cutting hair from an area of skin comprises an opening in which a heat-generating wire is mounted on a positionally adjustable frame. Optionally, one or more position adjusters are mounted between the frame and the structure. By moving the one or more position adjusters, the position of the heat-generating wire is adjusted with respect to the opening and/or the angle of the wire is adjusted with respect to the plane of the opening.

Optionally, the frame is fashioned so that it plugs into mounting sockets and a portion of the frame and/or the sockets are electrically conductive.

In an exemplary embodiment, the frame comprises two or more posts, each post having a guideway in which the wire is centered. In an exemplary embodiment, at least one of the posts is resilient so that it maintains the wire in tension, for example, during longitudinal expansion that may occur during heat generation and/or due to pressure as the wire presses against the hair. Optionally, at least one post is relatively flexible when force is applied along the axis of the wire and/or relatively non-flexible when force is applied perpendicular to the axis of the wire.

According to an aspect of some embodiments of the present invention, a method is provided for tensioning a heat-generating wire on a frame comprising two resilient posts. Optionally each post has a wire guide channel in which the wire rests or is held. In an exemplary embodiment, the wire is pulled against the guide channels at an angle that causes the posts to bent toward each other. While the posts are bent, the wire is attached to the frame or the posts themselves so that the posts remain bent to maintain the wire in tension after an external tensioning force is removed. Optionally, the wire is tensioned during the tensioning and attachment process using one or more tension-providing mechanisms. In an embodiment of the invention, the posts are springy or resilient, which terms are used interchangeably herein.

According to an aspect of some embodiments of the present invention, a structure having a heat-generating wire adapted to vibrate during cutting of hair, comprises a collection apparatus that collects cut hair. The collection apparatus, for example, comprises an electrostatically charged bar to which the cut hair is attracted. Optionally, the bar includes a comb and/or a brush to aid in bringing the cut hair proximal to the electrostatic charge. Optionally, the collection apparatus comprises a collection area, for example a cavity juxtaposed against the structure.

According to an aspect of some embodiments of the present invention, the structure comprises a deodorant dispenser adapted to dispense deodorant in response to heat and/or vibration. Optionally, the dispenser comprises a venturi opening to facilitate deodorant dispensation in response to vibration. Optionally, the dispenser is adapted to receive a solid and/or fluid deodorant that atomizes and/or vaporizes in response to heat and/or vibrations.

According to an aspect of some embodiments of the present invention, a structure having a heat-generating wire adapted to vibrate during cutting of hair, comprises an odor-reducing filter juxtaposed near the wire, through which odors generated by the wire pass. Optionally, the filter comprises an absorbent material adapted to receive an odor reducing deodorant that further reduces the odors during said passage. In an exemplary embodiment, a rotating impeller is juxtaposed in proximity to the filter to cause passage of the odors through the filter.

There is therefore provided, in accordance with an exemplary embodiment of the invention, a hair cutting apparatus comprising:

an elongate element heated to a temperature capable of cutting hair;

a vibrating structure, on which said elongate element is mounted; and a housing in which the vibrating structure is mounted.

Optionally, vibrations of the vibrating structure causes the heat-generating element to pass two or more times over hair as the apparatus is moved slowly along a hair containing area of the skin.

Optionally, the elongate element is mounted between two posts separated by a distance, one or both of the posts comprising a springy material, adapted to tension to the wire. Optionally, each springy post is relatively flexible in response to force applied in a first direction, and relatively non-flexible in response to force applied in a second direction. Optionally, at least a portion of the posts comprises a guideway against which at least a portion of the wire is mounted. Optionally, the posts are electrically conductive. Optionally, the wire is connected to the posts.

Optionally, the apparatus includes electrically conductive sockets on the structure adapted to receive the posts.

Optionally, the apparatus includes two or more post stabilizers, which limit the movement of the posts with respect to the housing in a direction perpendicular to an axis of the wire.

In an embodiment of the invention, the apparatus includes an eccentric rotating weight that causes the structure to vibrate as the weight rotates. Optionally, the apparatus includes a motion detector that turns the vibrating structure on or off in response to movement of the wire along the area. Optionally, the motion detector turns the vibrating structure on and off in response to a minimum speed. Optionally, the motion detector provides an indication of speed in excess of a given value. Optionally the indication comprises a visual indication. Optionally, the indication comprises a shutting off of the vibration.

In an embodiment of the invention, the motion detector additionally controls the generation of heat on the elongate element. Optionally, the motion detector turns the heat generating element off in response to a measurement of a speed less than a predetermined speed. Optionally, the motion detector turns the heat generating element off in response to a speed greater than a predetermined speed. Optionally, the motion detector comprises at least one of a mechanical motion detector and an optical motion detector.

In an embodiment of the invention, the heated element is a wire.

In an embodiment of the invention, the apparatus is a hand held apparatus adapted to be pressed against the skin of a user and cut hair on said skin.

There is further provided, in accordance with an embodiment of the invention, a method of cutting hair from an area of skin with a vibrating heat-generating wire, comprising:

a) heating an elongate element to a temperature high enough to cut the hair;

b) placing the heated elongate element against the area; and c) vibrating the element in a direction perpendicular to a long axis thereof, so that it makes multiple passes over the area during the placement.

Optionally, the method includes collecting the cut hair. Optionally, the method includes moving the cut hair into a receptacle.

Optionally, the method includes moving the elongate element along the surface of the skin of an area from which hair is to be removed by hand.

In an embodiment of the invention, the elongate element is a wire.

In an embodiment of the invention, the method includes moving the elongate element along the surface of the skin of an area from which hair is to be removed by hand.

There is further provided, in accordance with an embodiment of the invention, an A method of manufacturing a tensioned heat-generating wire, comprising:

positioning a wire on two separated posts, at least one of which is resilient in a direction along the wire axis;

tensioning the wire in a direction and by an amount sufficient to deform the posts so that the positions of the wire on the posts toward each other; and fixing the wires in place so that they remain tensioned by the deformed post or posts.

Optionally, when at least one of the posts is provided with a guide for the wire and including:

positioning the at least one wire guide;

pulling at least one ends of the wire extending past the postions of the wires on the post in a direction having a zero or acute angle with the axis of the post, to bend the post toward the other post.

Optionally fixing comprises fixing the wire to its respective post while it is tensioned.

In an embodiment of the invention the positioning occurs at the tip of the at least one post and the fixing occurs proximal to the tip.

There is further provided, in accordance with an embodiment of the invention, a hair cutting head, for use in a hair cutting apparatus and having a portion adapted for contacting an area of skin having hair, the head comprising:

a) at least two rows of elongate skin depressing elements defining an opening in the structure;

b) an elongate element situated in the opening and capable of producing heat sufficient to cut hair, when electrified; and c) a base on which the elements of the head are mounted, wherein long axes of the skin depressing elements are pointed generally toward the center of the opening.

Optionally, the long axes make an angle of less than about 20 degrees with a plane defined by the opening. Optionally, the two or more skin depressing elements are separated by a gap in which the elongate element is located.

In an embodiment of the invention, the elongate element comprises a wire.

In an embodiment of the invention, the head includes one or more position adjuster mechanisms juxtaposed between the frame and the structure.

There is further provided, in accordance with an embodiment of the invention, a hair cutting head, for use in a hair cutting apparatus and having a portion adapted for contacting an area of skin having hair, the head comprising:

a) a positionally adjustable frame moveably mounted on the structure;

b) a heat-generating elongate element capable of producing heat sufficient to cut hair, mounted on the frame near the opening; and c) one or more position adjuster mechanisms juxtaposed between the frame and the structure.

Optionally, one or more adjuster mechanisms adjust the overall position of the wire with respect to the opening. Alternatively or additionally, the one or more adjuster mechanisms adjusts the angle of the wire with respect to the plane of the opening.

Optionally, the elongate element is a wire.

Optionally, the head also includes at least two mounting pins suitable for mounting the head in a hair cutting apparatus said pins being electrically connected to said elongate element.

There is further provided, according an an embodiment of the invention, a hair cutting apparatus including:

a head according to the invention;

a power source operative to heat the elongate elements to a temperature sufficient to cut hair.

Optionally, the head also includes at least two mounting pins electrically connected to said elongate element and wherein the apparatus includes matching mounting sockets, electrically connected to said source.

Optionally, the apparatus also including means for vibrating the elongate element in a direction perpendicular to a long dimension thereof. Optionally, the means for vibrating is operative to vibrate the head with a motion causing said vibration of the elongate element.

In an embodiment of the invention, the apparatus is a hand held apparatus adapted to be pressed against the skin of a user and cut hair on said skin.

There is further provided, in accordance with an embodiment of the invention, a hair cutting apparatus comprising a structure having a portion adapted for contacting an area of skin having hair, the apparatus comprising:

a) a heat-generating elongate element producing heat sufficient to cut hair, mounted on the portion; and b) a deodorant or perfume dispenser juxtaposed in relation to the portion.

Optionally, the dispenser is adapted to dispense a deodorant or perfume in response to heat.

Optionally, the elongate element is adapted to vibrate.

In an embodiment of the invention, the deodorant dispenser is adapted to dispense a deodorant in response to vibration.

There is further provided, in accordance with an embodiment of the invention, a hair cutting apparatus comprising a structure having a portion adapted for contacting an area of skin having hair, the apparatus comprising:

a) a heat-generating element producing heat sufficient to cut hair, mounted on the portion; and b) a filter mounted on the portion; and c) a pump mounted on the structure, adapted to cause air to flow from the element through the filter.

Optionally, the filter dispenses a deodorant or perfume into air that passes through it.

There is further provided, in accordance with an embodiment of the invention, a hair cutting apparatus comprising a structure adapted for contacting an area of skin having hair, the apparatus comprising:

a) a heat-generating elongate element producing heat sufficient to cut hair, mounted on the portion; and b) an electrostatically charged element adapted for collecting cut hair.

Optionally, the electrostatically charged element further comprises at least one of: a brush, a comb, and a hair collection receptacle.

In an embodiment of the invention, the heated element is a wire.

In an embodiment of the invention, the apparatus is a hand held apparatus adapted to be pressed against the skin of a user and cut hair on said skin.

There is further provided, a method of collecting cut hair, comprising:

a) cutting hair with a heated elongate element; and b) collecting the hair cuttings with an electrostatically charged element.

Optionally, the electrostatically charged element comprises at least one of: a brush, a comb, and a hair collection receptacle.

Optionally, the method includes collecting the cut hair into a receptacle.

Optionally, the heated elongate element is a wire.

Optionally, the method includes moving the heated elongate element along the surface of the skin of an area from which hair is to be removed by hand.

BRIEF DESCRIPTION OF THE DRAWINGS

Exemplary non-limiting embodiments of the invention described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. The attached figures are.

DESCRIPTION OF EXEMPLARY EMBODIMENTS

Figure 1A:
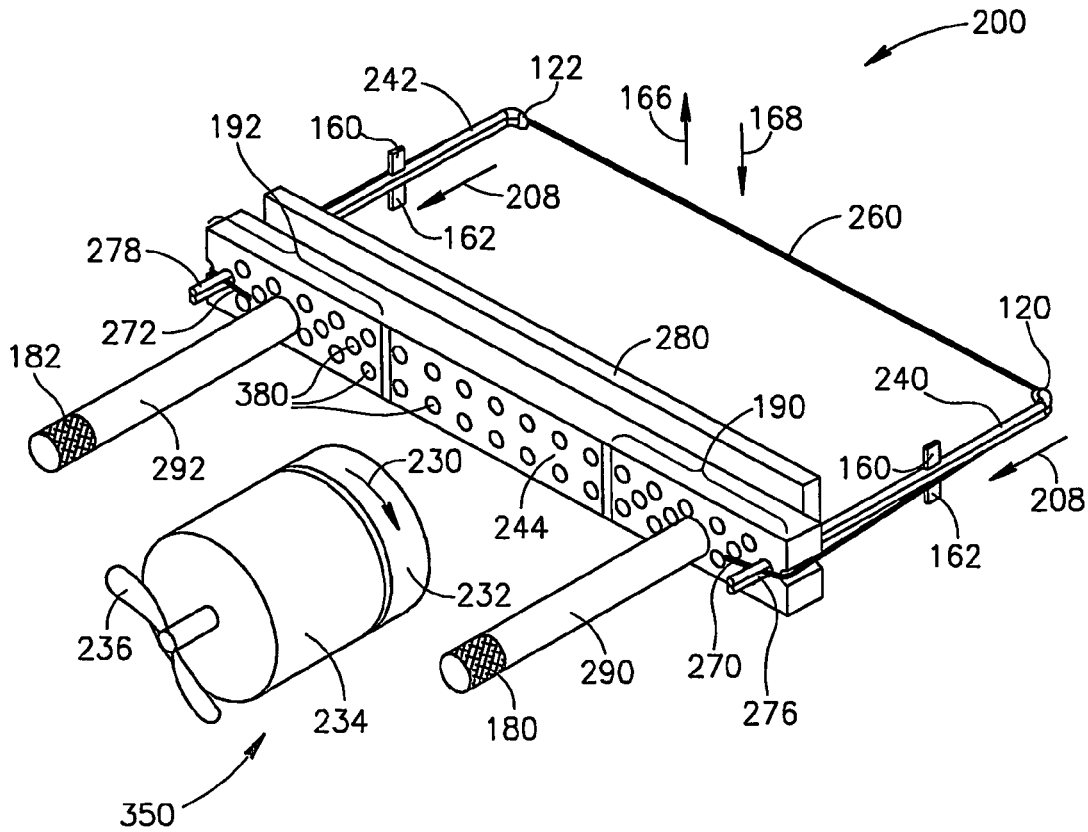
FIG. 1A is a schematic diagram of a structure supporting a heat-generating wire adapted for cutting hair, in accordance with an exemplary embodiment of the invention.

FIG. 1A is a simplified schematic diagram of a heat-generating wire 260 suspended on a frame 200, comprising two 240 and 242, in accordance with an exemplary embodiment of the invention. In an exemplary embodiment, posts 240 and 242 comprise wire guideways 120 and 122. Heat-generating wire 260 is optionally centered in guideways 120 and/or 122.

In an exemplary embodiment, posts 240 and 242 are held in position by a strut 244, for example substantially perpendicular to posts 240 and 242. Heat-generating wire 260, for example, is attached at wire ends 270 and 272 to posts 240 and/or 242.

In an exemplary embodiment, a conduction post 290 is electrically conductive and is attached to an electrically conductive area 190 while a conduction post 292 is electrically conductive and is attached to an electrically conductive area 192. Further, tension-providing posts 240 and 242 are electrically conductive and connected to conductive areas 190 and 192 respectively so that power provided through posts 290 and 292 causes wire 260 to generate heat.

In an exemplary embodiment, one or both of tension posts 240 and 242 are manufactured from a springy electrically conductive material so that when properly positioned they serve to keep heat-generating wire 260 taut during motion across a skin surface. Optionally, posts 240 and/or 242 are relatively flexible so they bend when subjected to a force pushing them towards each other. Optionally, posts 240 and/or 242 are relatively inflexible so they do not bend when subjected to a force pushing them perpendicular to the axis of wire 260.

In an exemplary embodiment, tensioning of wire 260 during manufacture is accomplished, for example, in the following manner, when one or both of the posts are springy:

With the wire placed in guides 120 and 122, wire ends 270 and/or 272 are pulled in a direction 208, with sufficient force and/or at an appropriate angle, with respect to (horizontal) wire 260, to cause posts 240 and 242 to bend toward each. Wire 260 is then attached to posts 240 and/or 242, for example at points 276 and 278 respectively, using solder, electrically conductive glue (such as conductive epoxy) and/or other connection means known in the art. Mechanical connection such as clamping can also be used. Optionally the clamp is copper or gold coated to provide a slightly conforming and highly conductive mechanical electrical connection. It should be noted that posts guideways 120 and/or 122 may be continually bent toward each other by the tension of wire 260. After attachment to the posts, free ends of the wires may be removed.

A similar method may be used if only one post is springy (or even if both are springy). In this case, wire 260 is optionally permanently attached to the inflexible post (or optionally to the frame), before or after tensioning. Then the other end of the wire is tensioned as aforesaid and the then attached to the frame or post on which it is mounted. Optionally, especially when the wire is pre-attached to one of the post, that post does not need a guide.

Optionally, additional tension to wire 260 is provided by one or more coiled springs between posts 240 and/or 242 and wire 260.

Figure 4:
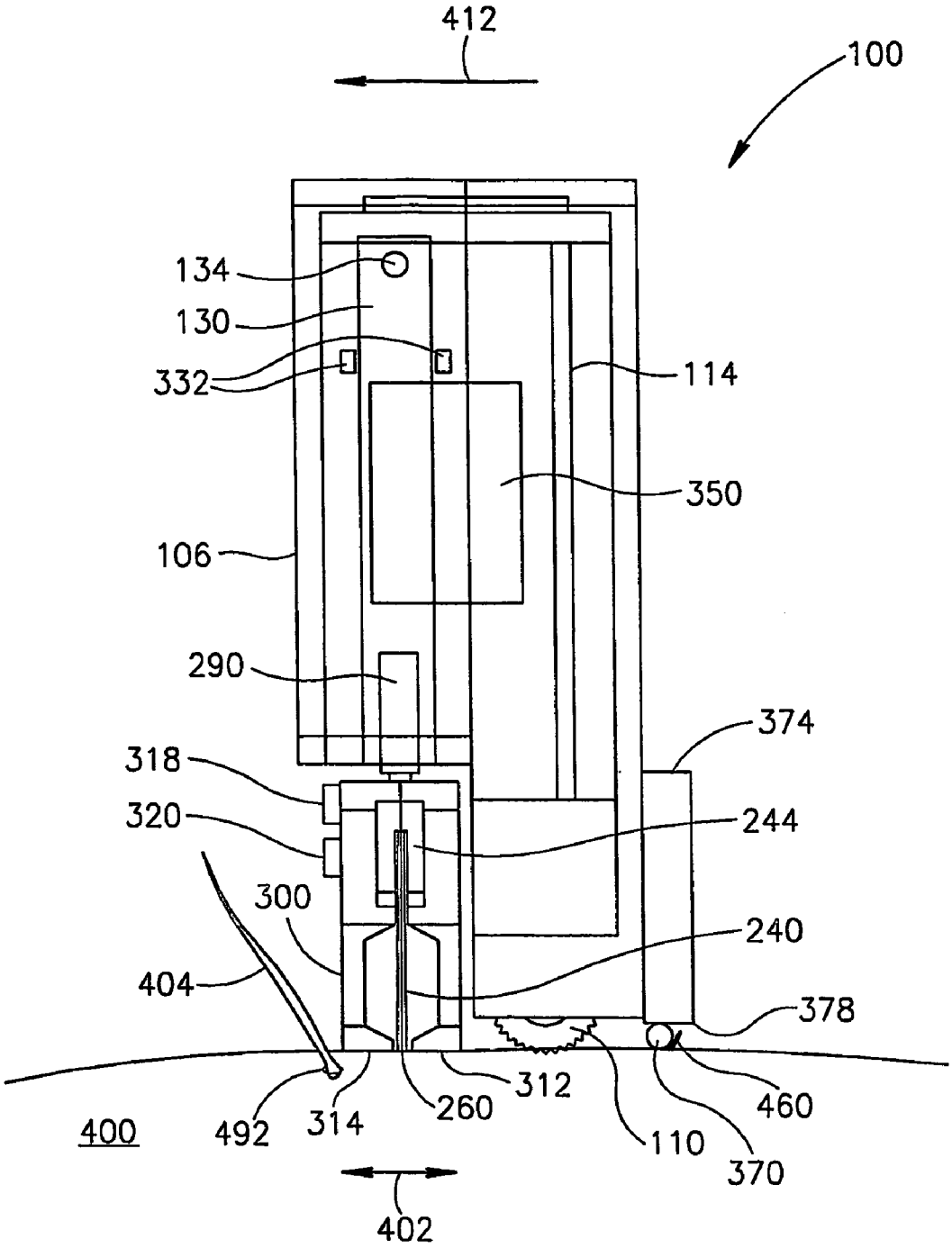
FIG. 4 is side cross-section of the vibrating hair cutting unit of FIG. 3, shown while cutting a hair, in accordance with an exemplary embodiment of the invention.

Tensioned wire 260, will remain in tension even in the presence of longitudinal expansion that occurs due to heating of wire 260 and/or due to pressure as wire 260 moves in a direction 402 against a hair 404 (FIG. 4).

One method of pulling wire ends 270 and/or 272 in direction 208 is by attaching wire ends 270 and/or 272 to on or more tension-providing wheels (not shown), positioned, for example on strut 244. By rotating the one or more wheels wire ends 270 and 272 are pulled in direction 208 to tension wire 260. Other methods for pulling wire 260 in direction 208 are known in the art and include, for example, attaching a spring mechanism and/or pneumatic tensioning device to wire ends 270 and/or 272.

In an exemplary embodiment, conductive post 290 fits into a socket 180 and conductive post 292 fits into a socket 182. A friction fit between sockets 180 and 182 and posts 290 and 292 is provided, for example to allow easy removal of frame 200 from sockets 180 and 182 for replacement of the entire frame or for cleaning and/or repair of wire 260. Sockets 180 and 182, for example, are conductive and capable of transmitting power from a power source, thereby providing electrical current to heat-generating wire 260 via posts 290 and 292, connection area 190 and 192 and tension posts 240 and 242. It is generally envisioned that the wire, posts and strut mechanism will be replaced when the wire breaks.

In an exemplary embodiment, post supports 160 are positioned against posts 240 and 242 to prevent undue motion in a direction 168. Alternatively or additionally, posts supports 162 are positioned against posts 240 and 242 to prevent undue motion in a direction 166. This assures that motion applied to frame 200 results in desired motion of the wire.

Figure 1B:
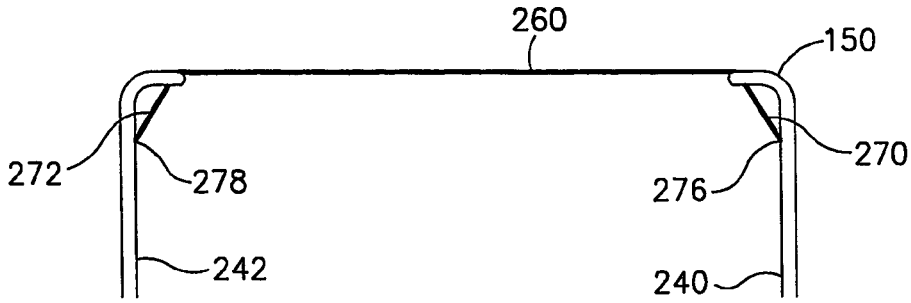
FIG. 1B is a schematic diagram of an alternative structure of FIG. 1A, in accordance with an exemplary embodiment of the invention.

FIG. 1B is a schematic diagram of an alternative structure of FIG. 1A, in accordance with an exemplary embodiment of the invention. In this embodiment, wire 260 passes through rings 150 and 152 in posts 240 and 242 prior to tensioning and attachment to the posts.

Figure 2:
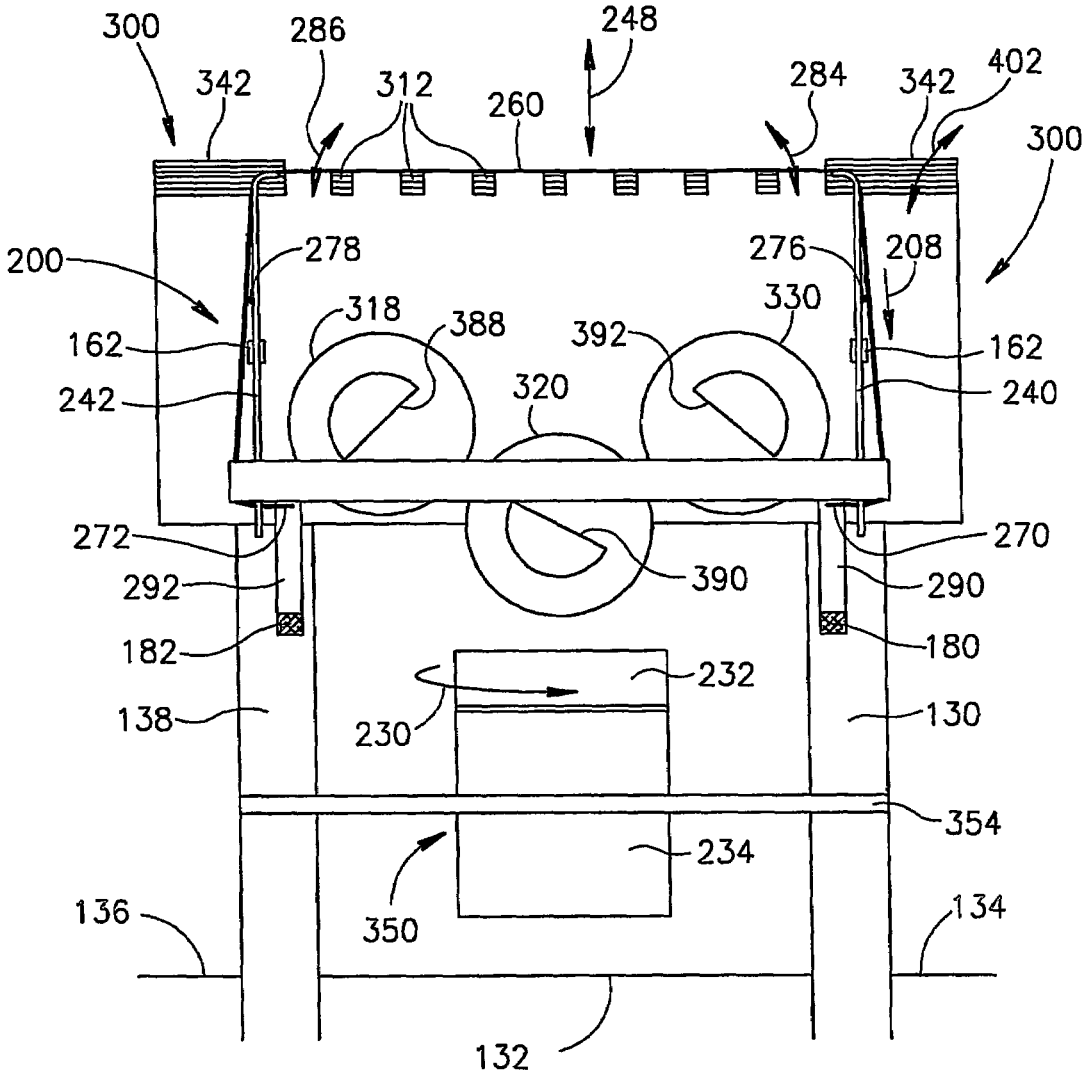
FIG. 2 is a schematic diagram of the structure of FIG. 1A including position adjusters, in accordance with an exemplary embodiment of the invention.

FIG. 2 is a schematic diagram of heat-generating wire 260 on frame 200 of FIG. 1A, mounted in vibrating compartment 300 that projects from vibrator posts 130 and 138. In an exemplary embodiment, a vibrator 350 connected to posts 130 and 138, comprises a motor 234 having an off-center weight 232 that causes vibration of vibrator 350 as motor 234 revolves in a direction 230. Alternatively or additionally, vibrator 350 is connected to posts 130 and 138 with a transverse connector 354.

An optional cross pin 132 passes through vibrator posts 130 and 138, allowing their movement around pin 132. As vibrator 350 vibrates, it imparts vibration to vibrator posts 130 and 138, thereby causing heat-generating wire 260 and/or compartment 300 to cyclically move in directions 402.

In cutting hair 404 (FIG. 4), vibration of wire 260, frame 200 and/or compartment 300 facilitates heat-generating wire 260 to make multiple passes over hair 404 while held against a given area of skin 400. Multiple passes of wire 260 increase the cutting efficiency of heat-generating wire 260 during each period it contacts area of skin 400 (i.e., as it is moved, by the user, across the skin surface). The excursion of the wire is between 0.2 and 2 mm, optionally between 0.5 and 1 mm.

In an exemplary embodiment, vibrating compartment 300, for example comprises a snap-together structure and/or is removably attached to vibrator posts 130 and 138 so that it can be removed for cleaning and/or to allow removal of frame 200 from sockets 180 and 182.

Figure 3:
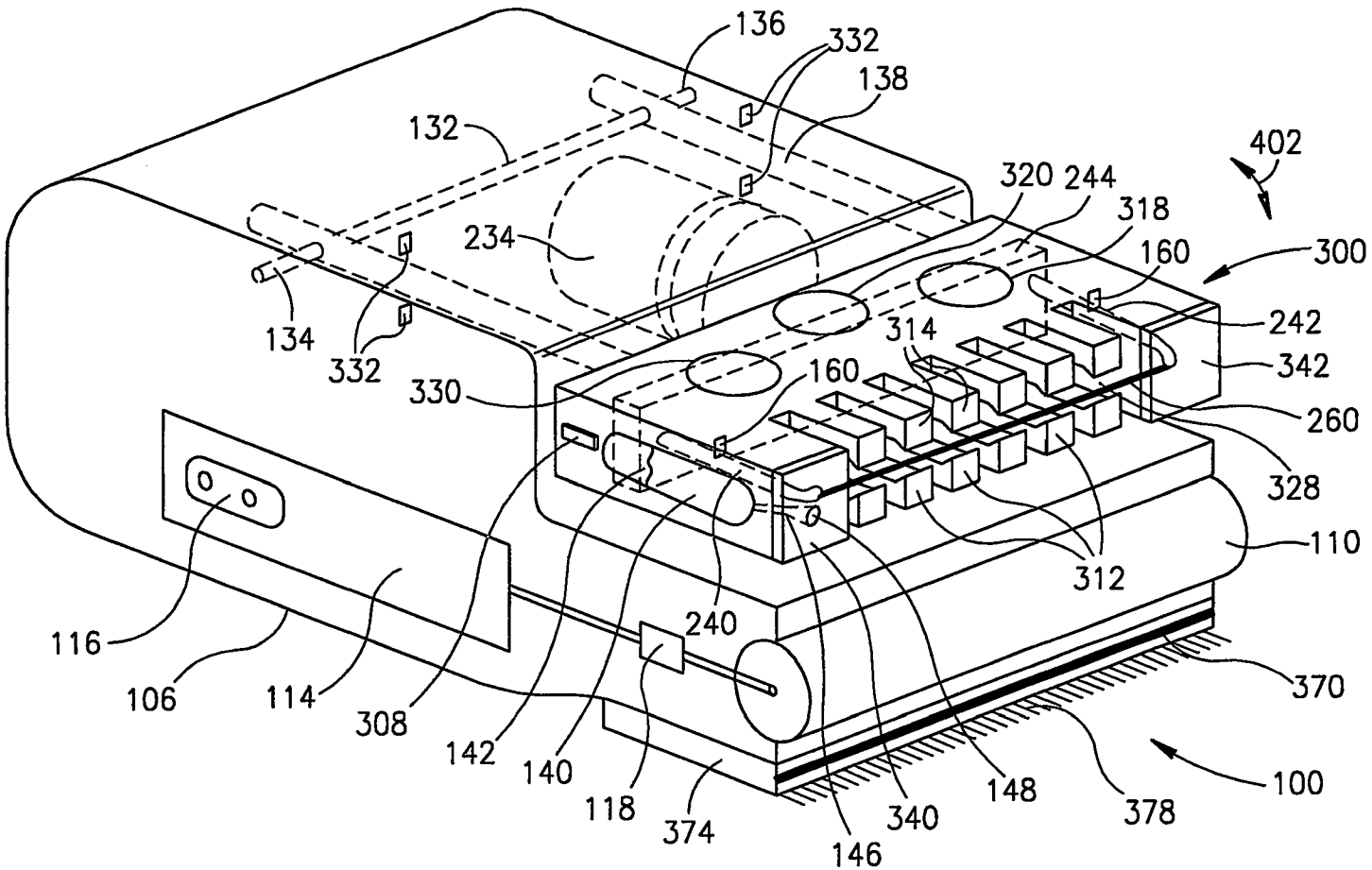
FIG. 3 is a partly sectioned isometric view of a vibrating hair cutting unit, in accordance with an exemplary embodiment of the invention.

As shown more clearly in FIG. 3, in an exemplary embodiment, compartment 300 comprises a row of skin-depressing elements 312. Skin-depressing elements 312 serve to depress and/or tighten area of skin 400 (FIG. 4), allowing heat-generating wire 260 to cut hair 404 without sinking into skin 400 and possibly dissipating its heat so that it cuts less efficiently and/or burns skin 400.

In an exemplary embodiment of the invention two rows of skin-depressing elements are provided on either side of heat-generating wire 260. Rows of skin depressors are shown in the PCT publications described above, for example, posts or the like. However, the skin depressors shown in the present embodiments differ from those shown in that they comprise elongate elements that whose long axis points generally toward the wire. The present inventors have found that the elongate elements shown herein provide for smoother and more comfortable travel of the shaver along the skin. Other configurations of skin-depressing elements 312, for example, comprising skin-depressing elements 312 at varied heights, angles, and/or planes with respect to skin 400 (FIG. 4), wire 260 and/or compartment 300, are also contemplated in exemplary embodiments of the invention. In preferred embodiments of the invention the long axis of the elongate elements is parallel to the plane of the opening (and thus of the skin) or are at a small (5, 10, 15 or 20 degrees) with respect to the plane.

Alternatively or additionally, post protectors 340 and 342 extend beyond posts 240 and 242 and/or skin-tensing and depressing elements 312. In an exemplary embodiment, post protectors 340 and 342 prevent the heat and/or vibrations from posts 240 and 242 from damaging skin 400 (FIG. 4) or vice-versa, by offsetting the proximate area of skin 400 proximal away from posts 240 and 242.

In an exemplary embodiment, wheels 318, 320 and/or 330 are juxtaposed against strut 244 and are rotatable so that flats 388, 390 and 392 respectively adjust the position of strut 244. Positional adjustments of strut 244 affect the position of wire 260 with respect to skin-depressing elements 312 and hence against area of skin 400. By rotating wheels 318, 320 and/or 330, an operator, for example, controls the closeness of heat-generating wire 260 to skin-depressing elements 312, adjusting the position of wire 260 in a direction 248. Alternatively or additionally, the operator adjusts the angle of wire 260 to skin-depressing elements 312, for example in directions 284 and/or 286.

Using wheels 318, 320 and/or 330 an operator can optimally position and angle of the wire with respect to plane of the end of depressors 312 (or the opening, if rows of depressors are not used).

FIG. 3 is cross-section of a vibrating hair cutting unit 100 having vibrating compartment 300 and a relatively non-vibrating structure 106, with wire 260 positioned within a gap 328. Optionally, skin-depressing elements 312 are elongate elements, positioned on one side of wire 260, pointing toward gap 328. As indicated above, a row of skin depressing elements 314 may comprise elongate elements on the opposite side of wire 260 gap that point toward gap 328. Optionally, post supports 160 and 162 are positioned against posts 240 and 242 to prevent wire 260 from contacting skin depressing elements 312 and/or 314.

Structure 106, for example, comprises a mechanical motion detector wheel 110 that rotates along a surface, for example area of skin 400 (FIG. 4) and signals a controller 118 that unit 100 is moving in relation to skin 400. In an exemplary embodiment, controller 118 turns vibrator 350 on or off in response to movement, thereby causing vibrator 350 to selectively provide vibrations.

Optionally, motion detector wheel 110 switches vibrator 350 on when unit 100 moves above a minimum speed in relation to skin 400 and switches vibrator 350 off when unit 100 moves below the minimum speed. In exemplary embodiments of the invention, the minimum speed is between 0.2 to 1 cm/second optionally about 0.5 cm/sec. In some embodiments of the invention, the motion detector also indicates when the speed is above a value to cause proper hair removal. In general, this speed is above 3 cm/sec. However, this value may vary depending on the amount diameter and temperature of the wire. Alternatively or additionally, mechanical motion detector 110 comprises an optical motion detector that directs controller 118 to switch vibrator 350 on or off. Optionally, in addition to controlling vibrations, motion detector 110 functions to switch heat generated by wire 260 on or off in response to motion of unit 100 on skin 400. Optionally, the system includes a visual indication of whether the heat and/or vibration are activated, as for example a light. In an embodiment of the invention the light is green when the velocity is in a desired range and red when it is outside this range.

In an exemplary embodiment, a battery 114, for example, provides power to vibrator 350 and/or wire 260. Optionally, battery 114 is rechargeable and, for example, linked by a power input 116 to an external power source, for example a power converter and/or an AC electric power receptacle (not shown). Alternatively or additionally, power input 116 is directly connected to wire 260 and/or vibrator 350 without battery 114 intervening and wire 260 is powered, for example, by AC current.

For clarity of presentation, in these embodiments, connections, for example between tension posts 240 and 242, and/or vibrator 350, and power supply 114, are not shown. However in an exemplary embodiment, a simple arrangement of electrical connectors is used to electrify heat-generating wire 260, vibrator 350 and/or other components associated with unit 100.

In an exemplary embodiment, cross pin 132 has end pins 134 and 136 that attach to structure 106, allowing vibrating compartment 300 to vibrate on posts 130 and 138 in relation to structure 106. One or more movement limiters 332 that abut post 130 and/or 138 to limit excursion of posts 130 and 138 during vibration of compartment 300 optionally project from housing 106. In an exemplary embodiment, movement limiters 332 comprise compressible material, for example a silicone. In an alternative exemplary embodiment, frame 200 is connected directly to vibrator 350 and compartment 300 and structure 106 remain stationary while heat-generating wire 260 vibrates in relation to skin 400.

In an exemplary embodiment, compartment 300 comprises a container 140 adapted for receiving a fluid and/or solid deodorant 142. Container 140, for example, is joined to a passage 146 having a venturi opening 148. Deodorant 142 atomizes as compartment 300 vibrates and is distributed through venturi opening 148 to the area around wire 260 and/or to skin 400.

Alternatively or additionally, deodorant 142 vaporizes in response to heat provided by heat-generating wire 260.

Alternatively or additionally a cover 310 is provided on passage 146 and a user-operated trigger 308 is provided on structure 106 that opens cover 310 to release vapors and/or aerosol from deodorant 142.

No matter what type of dispensation means is used, though, as deodorant 142 atomizes and/or vaporizes, it passes through communication passage 146 to the general area of heat-generating wire 260 and skin 400, thereby masking and/or neutralizing odors generated during cutting of hair. The deodorant (which can be a perfume that masks the smell of the burnt hair), can be provided in different popular scents In still another alternative exemplary embodiment shown in FIG. 1A, a smoke and/or odor-removing filter 280 is located over ventilation holes 380 in strut 244. A rotatable ventilator prop blade 236 (or other pumping mechanism) rotates to cause odors to be drawn through filter 280. A ventilator passage connecting an input of filter 280 to holes 380 may be provided more complete flow of the air containing the burnt odor to filter 280

Optionally, filter 280 comprises a porous material that absorbs a deodorant, for example a liquid deodorant and an operator places liquid deodorant on at least one area of filter 280. As odors pass over filter 280, they are neutralized and/or replaced with a pleasant fragrance. Optionally, odor-removing filter 280 is located in or adjacent a receptacle 374 that additionally collects cut hair 460 (FIG. 3).

Optionally, blade 236 is activated together with the heat and/or vibration. Optionally, it is deactivated at the same time as one or both of these elements or operates for a somewhat longer time to provide additional odor removal.

FIG. 4 is schematic cross-sectional view of vibrating hair cutting unit 100 cutting hair 404 that is growing from area of skin 400, in accordance with an exemplary embodiment of the invention.

In an exemplary embodiment, an electrostatic outcropping 370 is incorporated into unit 100, for example near motion detector wheel 110 and electrostatically attracts a cut hair 460 cut by heat-generating wire 260. Electrostatic outcropping 370, for example, Teflon will self charge, by friction with the skin, to an extent suitable for attracting the hair. Other charging means and materials can also be used.

Optionally, hair collection receptacle 374 is juxtaposed near outcropping 370 to collect cut hair 460 that accumulates on outcropping 370. Optionally, receptacle 374 has a collection aid 378, comprising a comb or brush, that brings cut hair 460 in proximity of outcropping 370.

In an exemplary embodiment, the current through wire 260 is 0.5 A, though it may vary, depending on the dimensions and/or materials comprising wire 260. In order to cut efficiently, wire 260, for example, reaches a peak temperature of between 700 and 800° C., when wire 260 is held against hair 404 for 10–100 milliseconds, optionally 25–75 milliseconds.

Lower temperatures, for example 500° C., can be used to cut hair 404 when wire 260 is held against hair for longer periods of times, for example, 50–150 milliseconds. Higher temperatures, for example 1000° C., can be used to cut hair 404 when wire 260 is held against hair 404 for shorter periods of time, for example, 5–15 milliseconds.

Power supply 114, for example, produces between 3 and 30 volts and between 0.030 and 5 amperes, depending on the dimensions of wire 260.

In an exemplary embodiment, wire 260 has a diameter of 0.07–0.1 millimeters. Alternatively, wire 260 has a diameter of above 0.1 millimeters, when manufactured from a less flexible and/or weaker material and below 0.07 millimeters when manufactured from a more flexible and/or stronger material.

Wire 260 has a length, for example, of 25–30 millimeters though it could have a length greater than 30 millimeters or less than 25 millimeters, based upon, for example, the amount of hairs 404 that it is designed to cut on each pass.

In an exemplary embodiment, wire 260 is manufactured from Kantaal D, (an alloy of nickel chromium and other metals manufactured by Kantaal Group). Alternative materials for wire 260 include Nichrome or other wire resistance materials Examples of springy electrically conductive materials used in manufacturing posts 240 and/or 242, include spring steel (SS 302) and beryllium copper. Optionally, the posts are plated with a material such as tin, which improves conductivity to the wire and solderability of the posts.

Skin-depressing elements 312 are shown as being straight comb-like pieces, though their shape could vary. Alternatively or additionally, rows of skin-depressing elements 312 with varied designs could be included in a kit provided with unit 100. For example, rows of skin-depressing elements 312 included in the kit could be curved along their length, semi circular or even end in round balls. Use of the various designs of rows of skin depressors 312 could be based on, for example hair density and/or preference of the operator.

A variety of numerical indicators have been utilized to describe the heat-generating wire. Additionally, a variety of numerical indicators have been utilized to describe structures besides heat-generating wire, including length, diameter and position of skin depressors in relation to the heat-generating wires. It should be understood that these numerical indicators could vary even further based upon a variety of engineering principles, materials, intended use and designs incorporated into the invention. The reader is further referred to the above referenced PCT applications, which contain numerous variations on many of the features described herein.

It should be further understood that the individual features described herein can be used together, in the manner above, in a single shaving device. Alternatively, each of the features (or some combination of them) can be used separately, for example, by being added to one of the devices shown in the above referenced PCT publications. Furthermore, it should be understood that the examples given above are exemplary in nature and are not intended to limit the scope of the invention or the claims.

The terms "include", "comprise" and "have" and their conjugates as used herein mean "including but not necessarily limited to."

The invention claimed is:

1. A hair cutting apparatus comprising:

a structure, a portion of which is adapted for placement against a skin surface in an area where hair is to be cut;

an elongate element heated to a temperature capable of cutting hair at least a portion of the elongate element being juxtaposed with said portion;

a vibrating structure, on which said elongate element is mounted such that the elongate element does not bum the skin surface; and a housing in which the vibrating structure is mounted.

2. Apparatus according to claim 1, wherein vibrations of the vibrating structure causes the heat-generating element to pass two or more times over hair as the apparatus is moved slowly along a hair containing area of the skin.

3. Apparatus according to claim 1, wherein the elongate element is mounted between two posts separated by a distance, one or both of the posts comprising a resilient material, adapted to tension the elongate element.

4. Apparatus according to claim 3, wherein each post is relatively flexible in response to force applied in a first direction, and relatively non-flexible in response to force applied in a second direction.

5. Apparatus according to claim 3, wherein at least a portion of the posts comprises a guideway against which at least a portion of the elongate element is mounted.

6. Apparatus according to claim 3, wherein the posts are electrically conductive.

7. Apparatus according to claim 6 wherein the elongate element is connected to the posts.

8. Apparatus according to claim 6, including electrically conductive sockets on the structure adapted to receive the posts.

9. Apparatus according to claim 3, and including two or more post stabilizers, which limit the movement of the posts with respect to the housing in a direction perpendicular to an axis of the elongate element.

10. Apparatus according to claim 1, and including an eccentric rotating weight that causes the structure to vibrate as the weight rotates.

11. Apparatus according to claim 1 and including a motion detector that turns the vibrating structure on or off in response to movement of the elongate element along the area.

12. Apparatus according to claim 1 wherein the heated element is a wire.

13. Apparatus according to claim 1 wherein the apparatus is a hand held apparatus adapted to be pressed against the skin of a user and cut hair on said skin at or near the surface of the skin.

14. A method of cutting hair from an area of skin with a vibrating heat-generating element comprising:

a) heating an elongate element to a temperature high enough to cut the hair;

b) placing the heated elongate element against the area; and c) vibrating the element in a direction perpendicular to a long axis thereof, so that it makes multiple passes over the area during the placing.

15. A method according to claim 14 further comprising collecting the cut hair.

16. A method according to claim 15 including moving the cut hair into a receptacle.

17. A method according to claim 14 wherein the elongate element is a wire.

18. A method according to claim 14 and including moving the elongate element along the surface of the skin of an area from which hair is to be removed by hand.

19. Apparatus according to claim 1, wherein at least a portion of the elongate element contacts the skin.

20. A hair cutting apparatus comprising:

an elongate element heated to a temperature capable of cutting hair;

a vibrating structure, on which said elongate element is mounted such that the elongate element does not burn the skin surface;

a housing in which the vibrating structure is mounted; and a motion detector that turns the vibrating structure on or off in response to movement of the elongate element along the area.

21. Apparatus according to claim 20, and including an eccentric rotating weight that causes the structure to vibrate as the weight rotates.

22. Apparatus according to claim 20, wherein the motion detector turns the vibrating structure on and off in response to a minimum speed.

23. Apparatus according to claim 20, wherein the motion detector provides an indication of speed in excess of a given value.

24. Apparatus according to claim 23, wherein the indication comprises a visual indication.

25. Apparatus according to claim 23, wherein the indication comprises a shutting off of the vibration.

26. Apparatus according to claim 20, wherein the motion detector additionally controls the generation of heat on the elongate element.

27. Apparatus according to claim 26, wherein the motion detector turns the heat generating element off in response to a measurement of a speed less than a predetermined speed.

28. Apparatus according to claim 26, wherein the motion detector turns the heat generating element off in response to a speed greater than a predetermined speed.

29. Apparatus according to claim 20, wherein the motion detector comprises at least one of:

a) a mechanical motion detector; and b) an optical motion detector.

30. Apparatus according to claim 20, wherein the heated element is a wire.

31. Apparatus according to claim 20, wherein the apparatus is a hand held apparatus adapted to be pressed against the skin of a user and cut hair on said skin at or near the surface of the skin.

* * * * *